US005997365A

United States Patent [19]

Abe

[11] Patent Number: 5,997,365

[45] Date of Patent: Dec. 7, 1999

[54] CONNECTOR

[75] Inventor: Kimihiro Abe, Shizuoka, Japan

[73] Assignee: Yazaki Corporation, Tokyo, Japan

[21] Appl. No.: 09/036,791

[22] Filed: Mar. 9, 1998

[30] Foreign Application Priority Data

Mar. 10, 1997 [JP] Japan ..... 9-055001

[51] Int. Cl.[6] ..... H01R 13/436

[52] U.S. Cl. ..... 439/752; 439/598

[58] Field of Search ..... 439/752, 701, 439/686, 598

[56] References Cited

U.S. PATENT DOCUMENTS 4,973,268 11/1990 Smith et al. ..... 439/752

5,286,225 2/1994 Tsuji ..... 439/752

*Primary Examiner*—Gary F. Paumen

*Attorney, Agent, or Firm*—Morgan, Lewis & Bockius LLP

[57] ABSTRACT

A connector includes a housing body having terminals arranged thereon, a retaining portion formed at a front side of the housing body, a cover member attachable to the housing body, and an engagement portion formed at a wall of the cover member. In the connector, when the cover member is attached to the housing body, the retaining portion is engaged with the engagement portion, thereby aligning center axes of the housing body and the cover member with each other. The engagement portion of the cover member is an engagement hole of a circular shape, and the retaining portion of the housing body is a semi-spherical projection.

14 Claims, 4 Drawing Sheets

CONNECTOR

BACKGROUND OF THE INVENTION

1. Field of the Invention

This invention relates to a connector suitably used, for example, in a wire harness in an automobile.

2. Background

Recently, the number of electric parts, mounted on an automobile, has markedly increased. In this connection, the number of connectors accommodating terminals which are connected to wire harnesses, has much increased. Therefore it has been proposed to arrange the connectors intensively in a stacked manner.

For example, a connector assembly disclosed in U.S. Pat. No. 5,286,225, is shown in FIG. 5. The connector assembly includes connectors 1 and 2. The connectors 1 and 2 are first stacked together vertically. Then, a pawl 3*a* of a cover 3 is fitted relative to the lower connector 2, thereby assembling the combined-type connector.

However, in the above conventional connector assembly, because of the relation between a height (vertical dimension) a of the cover 3 and combined heights (b+c) of the upper and lower connectors 1 and 2, there is provided a play which allows the upper and lower connectors 1 and 2 to move upwardly and downwardly when the cover 3 is fitted on the connectors 1 and 2. Accordingly, when the connector is to be fitted relative to a mating connector, there is a possibility that distal ends of tabs of the terminals strike against terminals or other portions of the mating connector.

SUMMARY OF THE INVENTION

This invention has been made in order to overcome the above problem, and an object of the invention is to provide a connector in which when a cover member is attached to a housing body, having upper and lower rows of terminals arranged respectively on upper and lower sides thereof, to cover the housing body, the cover member can be easily and accurately fitted on the housing body while positively preventing a relative motion (that is, a play) between the cover member and the housing body.

According to the invention, there is provided a connector including a housing body having terminals arranged thereon, and a cover member attached to the housing body, an engagement portion formed at a fitting wall of the cover member, and a retaining portion formed at a front side of the housing body, the retaining portion being engaged with the engagement portions, thereby aligning center axes of the housing body and the cover member with each other.

In this connector, the housing body having the terminals arranged thereon, and the cover member covering the housing body, can be combined together with their center axes aligned with each other, without causing the relative movement (that is, a play) therebetween.

Further, in the connector, the engagement portion of the cover member may be an engagement hole of a circular shape, and the retaining portion of the housing body may be a semi-spherical projection.

In this connector, the housing body can easily be fittingly connected to the fitting wall of the cover member, and the efficiency of the assembling operation is very good.

Further, in the connector, upper and lower rows of terminals are arranged to be juxtaposed respectively in upper and lower terminal receiving portions of the connector body which are disposed respectively on upper and lower sides of the center axis of the housing body, and insertion holes for mating connector terminals are formed through the fitting wall of the cover member, and are disposed in alignment with the upper and lower rows of terminals, respectively.

In this connector, the multi-pole design of the connector can be easily achieved, and the versatility of the connector can be further enhanced.

Furthermore, in the connector, the cover member has two opposing side walls, and the housing body has two opposing side walls. The two opposing side walls of the cover member may include lock portions, and the two opposing side walls of the housing body may include locking portions. When the cover member is attached to the housing body, the lock portions are respectively engaged with the locking portions. In this connector, the housing body can further accurately be positioned in the cover member.

DETAILED DESCRIPTION OF THE PREFERRED EMBODIMENT

Figure 1:
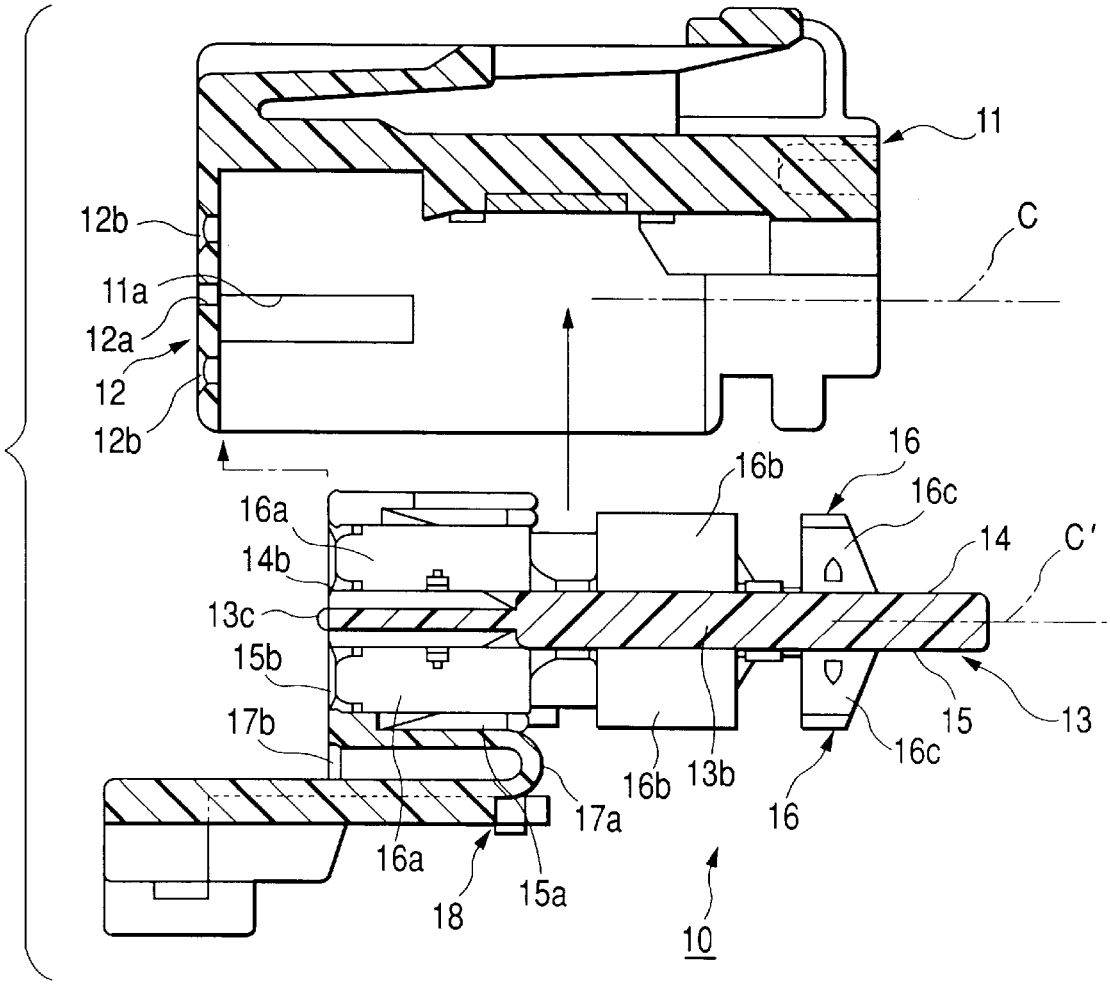
FIG. 1 is a cross-sectional view of one preferred embodiment of a connector of the present invention, showing a condition in which a housing body and a cover member are separated from each other.

One preferred embodiment of the present invention will now be described with reference to the drawings.

FIGS. 1, 3 and 4A–4C show one preferred embodiment of a press-connecting connector 10 suitably used, for example, in a wire harness in an automobile. This connector 10 includes a cover member 11 made of a synthetic resin, a housing body 13 of a synthetic resin fittingly connected to a fitting wall 12 of the cover member 11 provided at a front side thereof, a plurality of terminals 16 arranged in upper and lower terminal receiving portions 14 and 15 provided respectively on upper and lower sides of the housing body 13, with a center axis C' of the housing body 13 disposed between the upper and lower terminal receiving portions 14 and 15, a rear holder 18 of a synthetic resin integrally connected to the lower terminal receiving portion 15 of the housing body 13 through hinges 17*a* and bands 17*b*, and a rear cover 19 of a synthetic resin covering a rear portion of the cover member 11.

As shown in FIG. 1, the cover member 11 is in the form of a box having an open bottom and an open rear end, and the downwardly-extending, fitting wall 12 is formed integrally at the front end of the cover member 11. A pair of circular engagement holes 12*a* are formed in the fitting wall 12. A center axis C of the cover member 11 defines a reference axis which should be aligned with the center axis C' of the housing body 13 when the cover member 11 is attached to the housing body 13. In this embodiment, the engagement holes 12*a* are disposed respectively on opposite sides of the center axis C of the cover member 13. A row of insertion holes 12*b*, aligned respectively with the row of terminals 16 arranged to be juxtaposed in the upper terminal receiving portion 14 of the housing body 13, as well as another row of insertion holes 12*b*, aligned respectively with the row of terminals 16 arranged in the lower terminal receiving portion 15, are formed through the fitting wall 12. Terminals of a mating connector are inserted respectively through these insertion holes 12*b*. Lock grooves 11*a* and 11*a* are formed through generally central portions of opposite side walls of the cover member 11, and a pair of retaining pawls 13*a* and 13*a*, formed integrally respectively with opposite side walls of the housing body 13, are releasably engaged in the lock grooves 11*a* and 11*a*, respectively.

Figure 2:
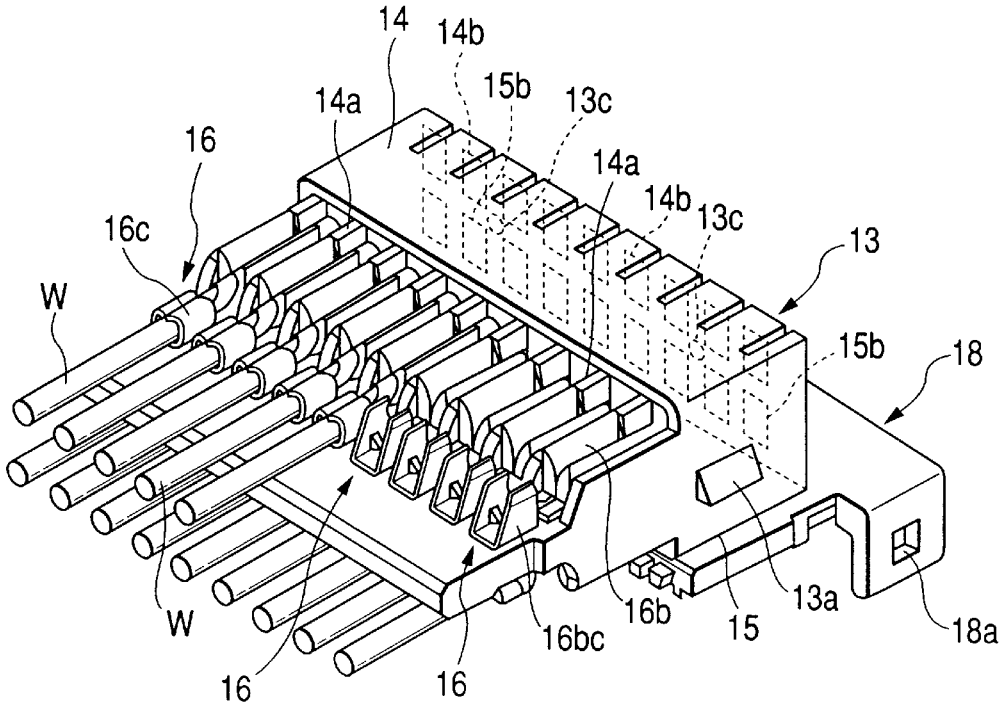
FIG. 2 is a perspective view of the housing body of the connector.
Figure 3:
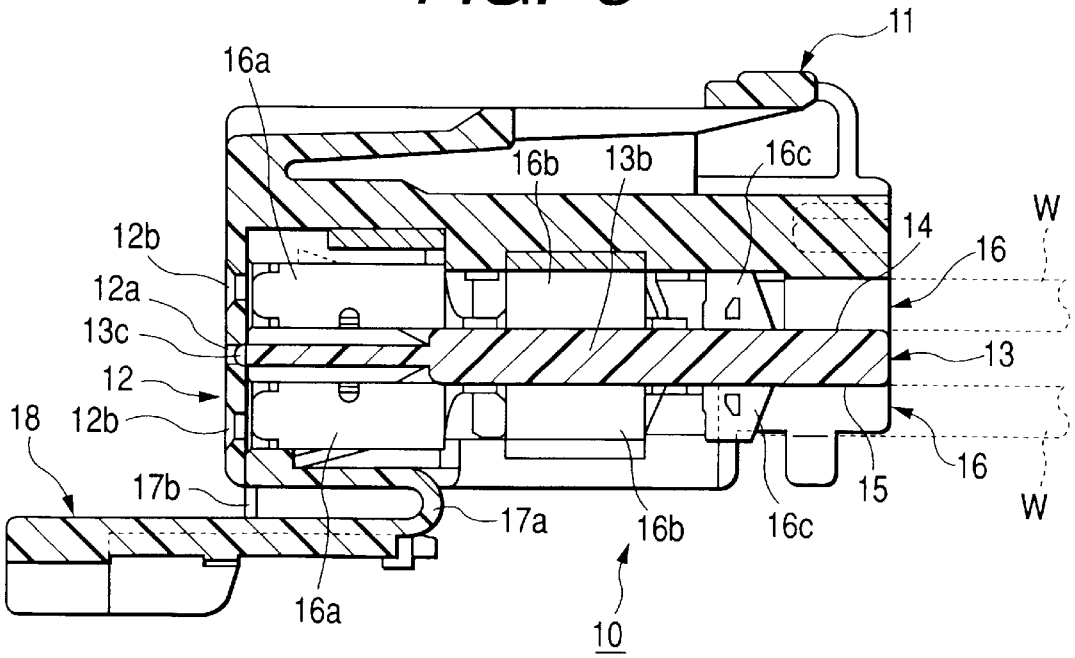
FIG. 3 is a cross-sectional view of the connector in its assembled condition.

As shown in FIGS. 1 to 3, the housing body 13 has a generally box-shape with an open rear side, and includes an integral horizontal plate portion 13*b* extending in a median plane thereof, the horizontal plate portion 13*b* serving as a partition wall separating the upper and lower terminal receiving portions 14 and 15 from each other. A pair of semi-spherical projections 13*c* and 13*c* are integrally formed respectively on the front surface of the housing body 13, and are disposed generally centrally of the height of this front wall. When the projections 13*c* are fitted respectively in the engagement holes 12*a* in the fitting wall 12 of the cover member 11, the cover member 11 and the housing body 13 are combined together, with their center axes C and C' aligned with each other. Partition walls 14*a*, which separate the juxtaposed terminals 16 from one another, are integrally formed at a front portion (close to the front wall of the housing body 13) of the upper terminal receiving portion 14 of the housing body 13, and similarly, partition walls 15*a* are integrally formed at a front portion of the lower terminal receiving portion 15. The terminals 16 are arranged between the partition walls 14*a* and 15*a*. Exposure holes 14*b* are formed through the front wall (the front wall of the housing body 13) of the terminal receiving portion 14 of the housing body 13, and contact portions 16*a* (for contact with the mating terminals) of the upper row of terminals 16 are exposed respectively through these exposure holes 14*b*. Similarly, exposure holes 15*b* are formed through the front wall of the terminal receiving portion 15, and contact portions 16*a* of the lower row of terminals 16 are exposed respectively through these exposure holes 15*b*.

As shown in FIGS. 2 and 3, a rear portion of each of the terminals 16 includes a press-connecting portion 16*b*, to which a wire W is press-connected, and a clamping portion 16*c* for clamping the wire W, the press-connecting portions 16*b* and the clamping portion 16 being formed by bending. A pair of engagement holes 18*a* and 18*a* are formed respectively through opposite side walls of the rear holer 18, and a pair of retaining pawls 11*b* and 11*b*, formed integrally respectively on rear end portions of the opposite side walls of the cover member 11, are releasably engaged respectively in these engagement holes 18*a* and 18*a*.

Figure 4A:
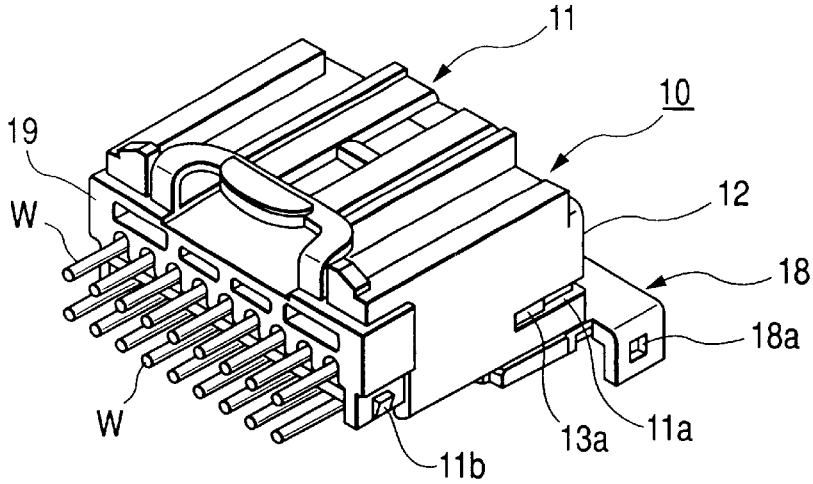
FIG. 4A is a perspective view of the connector, showing a rear holder held on the housing body.
Figure 4B:
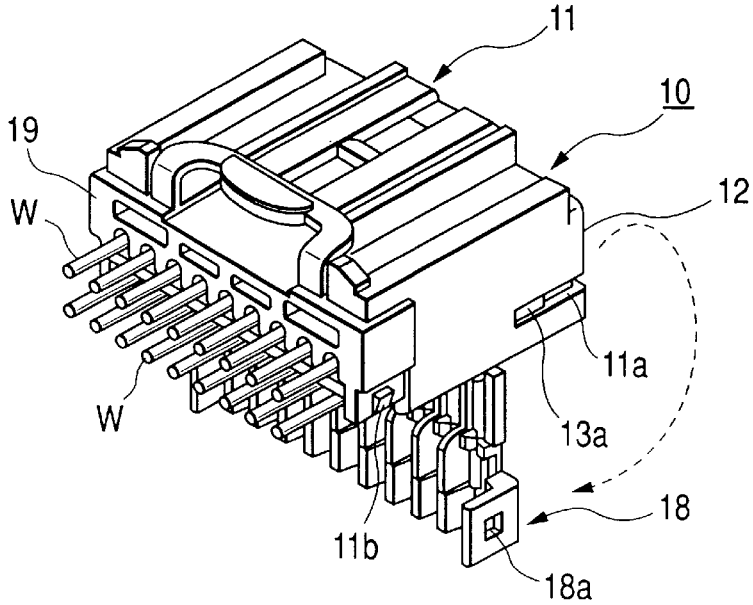
FIG. 4B is a perspective view of the connector, showing a condition in which the rear holder is pivotally moved.
Figure 4C:
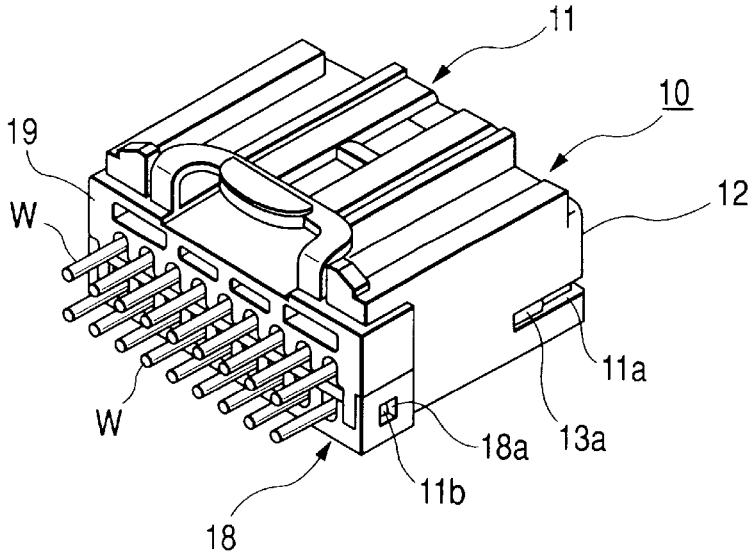
FIG. 4C is a perspective view of the connector in its completely assembled condition.
Figure 5:
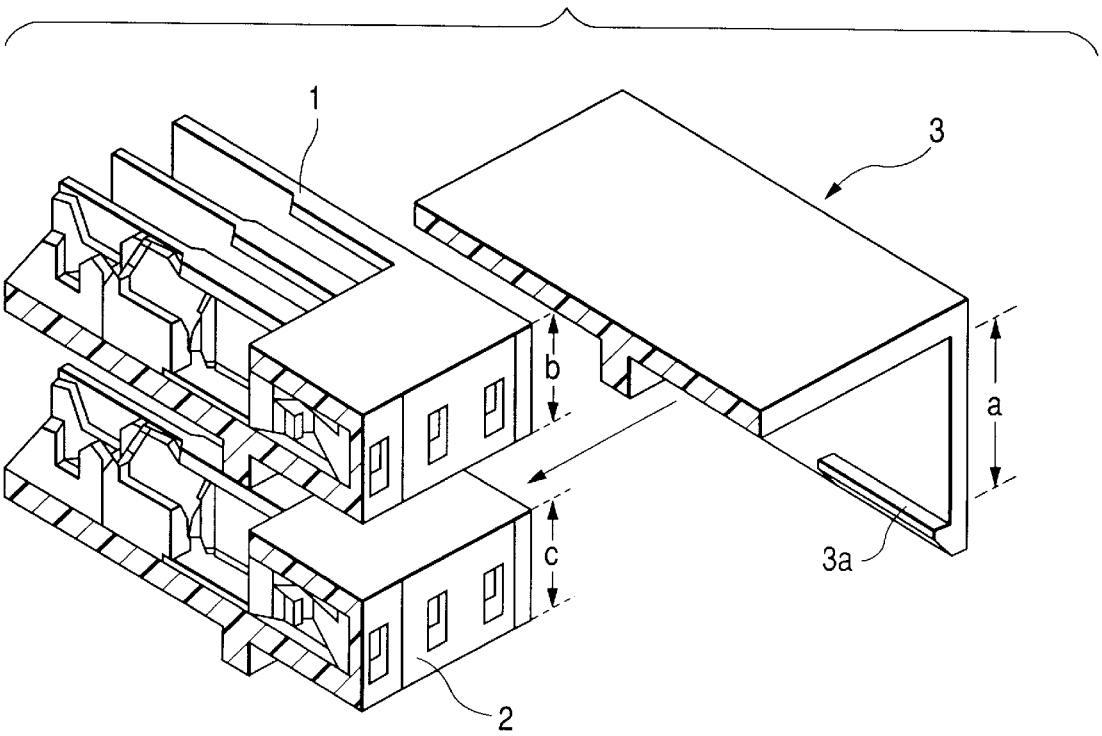
FIG. 5 PRIOR ART
FIG. 5 is a perspective view showing a partly cross-sectional view of a conventional connector assembly, showing a condition in which connectors and a cover are separated from each other.

In the above connector 10 of this embodiment, the housing body 13, having the plurality of terminals 16 arranged in the upper and lower terminal receiving portions 14 and 15 as shown in FIGS. 1 and 2, is first located beneath the cover member 11, and then is combined with the cover member 11, with the front surface of the housing body 13 mated with the inner surface of the fitting surface 12. At this time, the projections 13*c* on the housing body 13 are fitted respectively in the engagement holes 12*a* in the fitting wall 12 of the cover member 11, and the housing body 13 and the cover member 11 are easily and accurately combined together with their center axes C' and C aligned with each other, thus preventing the relative motion between the housing body 13 and the cover member 11, as shown in FIGS. 3 and 4A. At this time, since the lock grooves 11*a* and 11*a* of opposite side walls of the cover member 11, and the retaining pawls 13*a* and 13*a* of the opposite side walls of the housing body 13, are engaged with each other, the housing body can further accurately be positioned in the cover member.

Then, the bands 17*b* (see FIG. 3) of the rear holder 18 are cut, and the rear holder 18 is pivotally moved through the hinges 17*a* to cover the lower row of terminals 16 (see FIGS. 4B and 4C), and the upper row of terminals 16 is covered with the rear cover 19. Thus, the connector 10 is completely assembled.

As described above, the engagement holes 12*a* are formed in the fitting wall 12 of the cover member 11, and the projections 13 are formed on the front surface of the housing body 13. The projections 13*c* are fitted respectively in the engagement holes 12*a*, thereby coinciding the center axes C' and C of the housing body 13 and the cover member 11 with each other. Therefore, the housing body 13, having the terminals 16 arranged thereon, and the cover member 11 for covering the housing body 13, can be aligned with each other, without causing the relative movement (that is, a play) therebetween, and therefore the housing body 13 can accurately be fittingly connected to the fitting wall 12 of the cover member 11. Also, the housing body is accurately positioned in the cover member. The engagement holes 12*a* in the cover member 11 have a circular shape while the projections 13*c* on the housing body 13 have a semi-spherical shape, and therefore the housing body 13 can easily and certainly be fittingly connected to the fitting wall 12 of the cover member 11, and the efficiency of the assembling operation is very good. The two rows of terminals 16 are arranged respectively in the upper and lower terminal receiving portions 14 and 15 provided respectively on the opposite sides of the horizontal plate portion 13*b* of the housing body 13, and the insertion holes 12*b* for the mating terminals are formed through the fitting wall 12 of the cover member 11 in such a manner that these holes 12*b* are in alignment with the upper and lower rows of terminals 16, respectively, and therefore the multi-pole design of the connector can be easily achieved, and the versatility of the connector can be further enhanced.

In the above embodiment, although the two engagement holes 12*a* and 12*a* of the cover member 11 and the two projections 13*c* and 13*c* of the housing body 13 have been defined, the connector according to the present invention is not limited to the above embodiment. For example, one engagement hole 12*a* may be formed in the cover member 11 and one projection 13*c* may be formed on the front surface of the housing body 13.

Further, although the engagement holes 12*a* of the cover member 11 disposed respectively on the opposite sides of the center axis C of the cover member 11 and the projections 13*c* of the housing body 13 located correspondingly at the front surface of the housing body 13 have been defined, the connector according to the present invention is not limited to the above embodiment. For example, the projections 13*c* may be formed somewhere on a wall of the housing body 13 for defining the exposure holes 14*b*, and the engagement holes 12*a* are formed in the front surface of the cover member 11 so as to correspond to such the projections 13*c*.

Furthermore, although the engagement portions of the cover member 11 have been defined by the engagement holes 12*a* while the retaining portions of the housing body 13 have been defined by the semi-circular projections 13*c* in the above embodiment, the engagement portions and the retaining portions may have any other suitable shapes. For example, the engagement portions of the cover member may be in the form of rectangular holes while the retaining portions of the housing body may be in the form of hook-like projections.

Of course, the engagement holes 12*a* may replace with the projections 13*c* so that the projections 13*c* replace with the engagement holes 12*a*.

As described above, the housing body, having the terminals arranged thereon, and the cover member for covering the housing body, can be aligned with each other, without causing the relative movement (that is, a play) therebetween, and therefore the housing body can accurately and easily be fittingly connected to the fitting wall of the cover member.

Further, the housing body can easily and certainly be fittingly connected to the fitting wall of the cover member, and the efficiency of the assembling operation is very good.

Further, the multi-pole design of the connector can be easily achieved, and the versatility of the connector can be further enhanced.

What is claimed is:

1. A connector, comprising:

a housing body including a terminal receiving portion;

a first terminal insertable in the terminal receiving portion;

a retaining portion formed at a front, forwardly facing, substantially planar surface surface of the housing body at a mating end thereof;

a cover member attachable to the housing body, the cover member including a wall portion located in front of the front surface of the housing body when the cover member is attached to the housing body; and an engagement portion formed at the wall portion, wherein when the cover member is attached to the housing body, the retaining portion is engaged with the engagement portion so that the housing body is positioned in the cover member.

2. The connector of claim 1, further comprising a second terminal wherein the terminal receiving portion includes upper and lower terminal receiving chambers into which the first and second terminals are respectively insertable.

3. The connector of claim 2, wherein the front surface of the housing body has holes formed therethrough to communicate respectively with the inside of the upper and lower terminal receiving chambers, the wall portion of the cover member has holes formed therethrough to communicate respectively with the holes of the front surface of the housing body when the cover member is attached to the housing body.

4. The connector of claim 3, wherein the retaining portion is located between the holes of the front surface of the housing body, the engagement portion is located between the holes of the wall portion of the cover member.

5. The connector of claim 4, wherein the engagement portion has an engagement hole of a circular shape, the engagement hole is formed through the wall portion, the retaining portion has a semi-spherical projection.

6. The connector of claim 5, wherein when the cover member is attached to the housing body, the semi-spherical projection is fitted in the engagement hole to align center axes of the housing body and the cover member with each other.

7. The connector of claim 6, wherein the upper and lower terminal receiving chambers are disposed respectively on upper and lower sides of the center axis of the housing body, and wherein the first and second terminals are arranged to be juxtaposed in the upper and lower terminal receiving chambers, respectively.

8. The connector of claim 1, wherein the engagement portion has an engagement hole of a circular shape, the engagement hole is formed through the wall portion, the retaining portion has a semi-spherical projection.

9. The connector of claim 1, wherein when the cover member is attached to the housing body, the retaining portion is engaged with the engagement portions to thereby align center axes of the housing body and the cover member with each other.

10. The connector of claim 1, wherein the cover member has two opposing side walls each including a lock portion, the housing body has two opposing side walls each including a locking portion, and wherein when the cover member is attached to the housing body, each cover member lock portion is engaged with the respective housing body locking portion.

11. A connector, comprising:

a housing body having terminals arranged thereon;

a retaining portion formed at a front, forwardly facing, substantially planar surface of the housing body at a mating end thereof;

a cover member attachable to the housing body; and an engagement portion formed at a wall of the cover member, wherein when the cover member is attached to the housing body, the retaining portion is engaged with the engagement portion, thereby aligning center axes of the housing body and the cover member with each other.

12. A connector according to claim 11, in which the engagement portion is an engagement hole of a circular shape, the retaining portion is a semispherical projection.

13. A connector according to claim 11, further comprising upper and lower terminal receiving portions formed in the connector body, the upper and lower terminal receiving portions being disposed respectively on upper and lower sides of the center axis of the housing body, wherein the terminals are arranged to be juxtaposed in the upper and lower terminal receiving portions, respectively.

14. A connector according to claim 13, wherein the wall of the cover member has insertion holes formed therethrough to allow insertion of mating connector terminals, the insertion holes are disposed in alignment with the terminals, respectively.

* * * * *